US005494460A

United States Patent [19]

Kaiser

[11] Patent Number: 5,494,460

[45] Date of Patent: Feb. 27, 1996

[54] BLANK INSERT FOR LAMP REPLACEMENT IN A DECORATIVE STRING OF LIGHTS

[76] Inventor: Richard A. Kaiser, N84 W28518 Center Oak Rd., Hartland, Wis. 53029

[21] Appl. No.: 383,953

[22] Filed: Feb. 6, 1995

[51] Int. Cl.[6] ..... H01R 31/08

[52] U.S. Cl. ..... 439/509; 439/507

[58] Field of Search ..... 439/148, 507, 439/509, 513

[56] References Cited

U.S. PATENT DOCUMENTS 3,182,277 5/1965 Ashby ..... 439/509 OR
3,235,830 2/1966 Newton, Jr. ..... 439/507 OR
3,327,279 6/1967 Lombard ..... 439/509 OR
3,908,153 9/1975 Lason, Jr. ..... 439/507 X

*Primary Examiner*—P. Austin Bradley
*Assistant Examiner*—Daniel Wittels
*Attorney, Agent, or Firm*—Andrus, Sceales, Starke & Sawall

[57] ABSTRACT

A replacement blank for an incandescent lamp in a string of decorative lights includes a base adapted for removable insertion into one of the sockets of the light string in place of a lamp. The base is provided with an electrically conductive strip which is sized and shaped to maintain the series connection between the leads in the socket. The use of multiple replacement blanks in place of selected lamps in the string allows the user to create decorative patterns or designs where it is desirable to have sections of the string not lighted.

7 Claims, 2 Drawing Sheets

FIG. 1
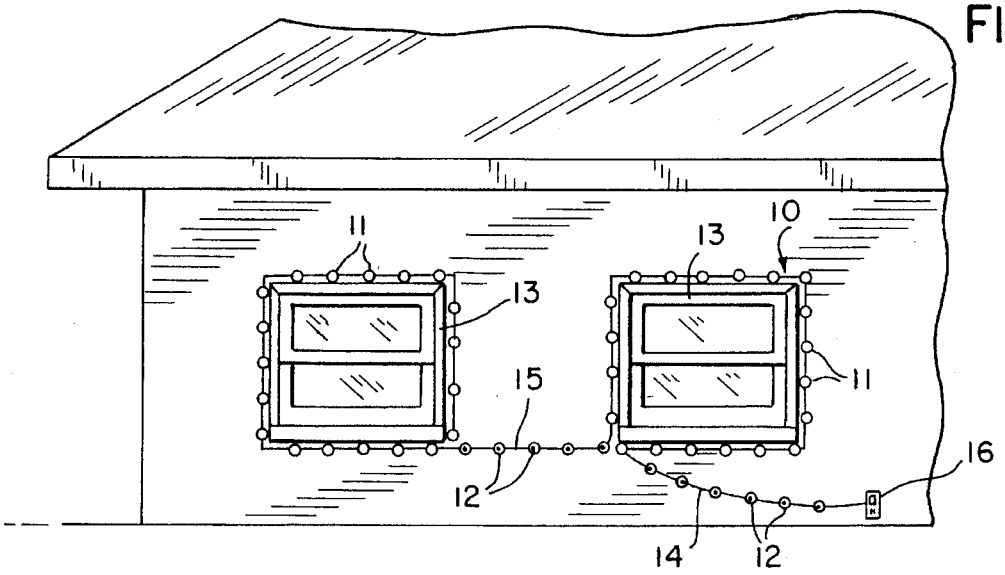
FIG. 2
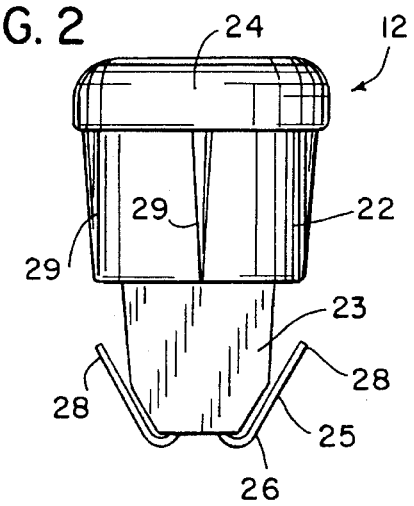
FIG. 3
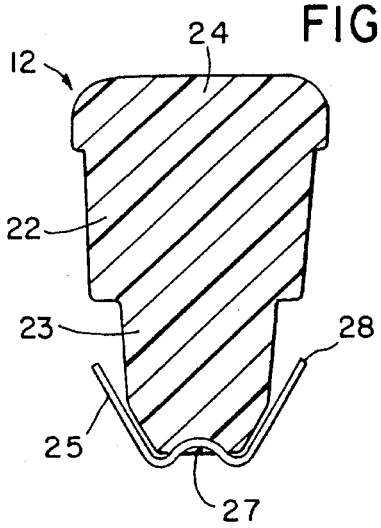
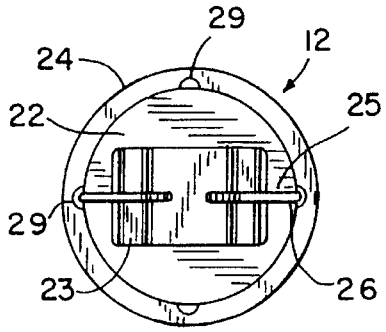
FIG. 4
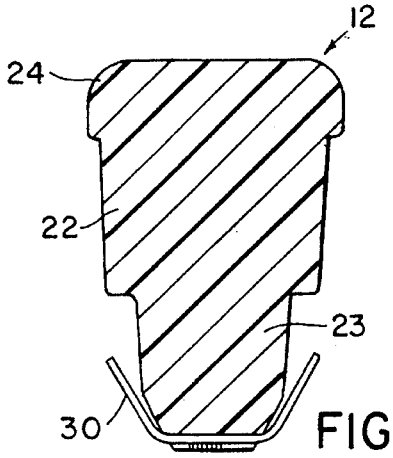
FIG. 5

FIG. 6
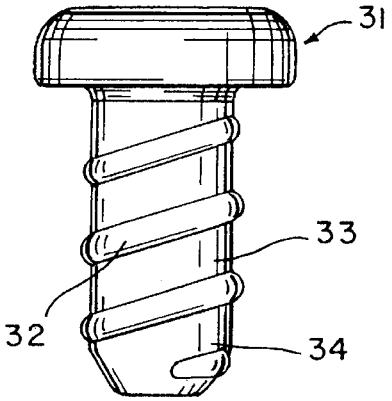
FIG. 7
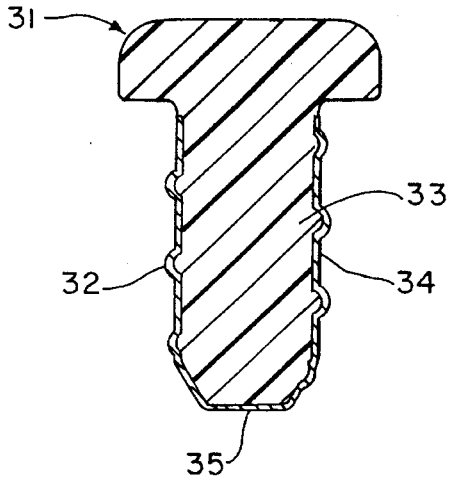
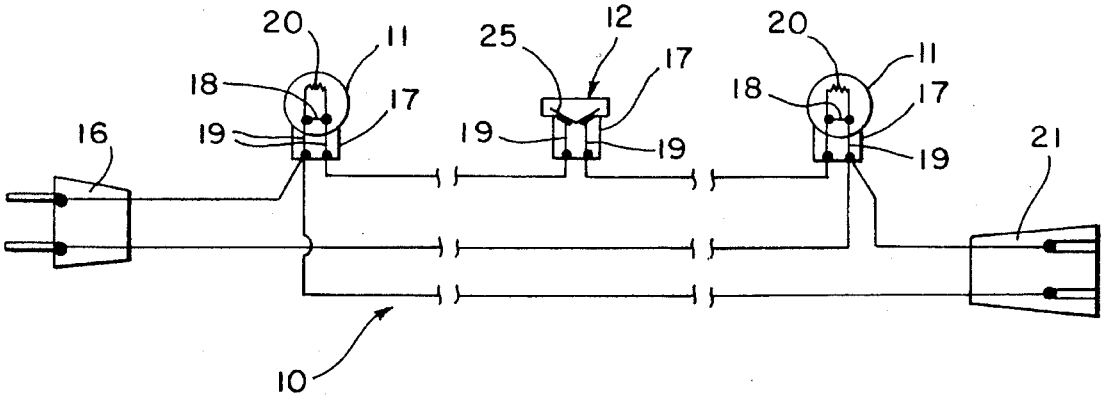
FIG. 8

BLANK INSERT FOR LAMP REPLACEMENT IN A DECORATIVE STRING OF LIGHTS

BACKGROUND OF THE INVENTION

The present invention pertains to decorative light strings comprising a plurality of electrically connected incandescent lamps and, more particularly, to a blank used as a replacement for a lamp in such a string where no light is desired.

Strings of decorative lights comprising individual interconnected incandescent lamps are well known in the art. For example, the typical Christmas tree light string may include as many as 50 or more individual lamps including lamp holders which are wired to allow successive strings to be connected in series. Series connection of multiple light strings facilitates the use of such strings to decorate a Christmas tree, but such connections are also useful when utilizing such light strings for other decorative purposes, such as decorating the outside of a house or creating a lighted decorative message. When utilizing interconnected light strings for such other decorative purposes, portions of one or more of the interconnected strings may span regions where it would be desirable not to have lighted lamps. For example, the spaces between windows encircled with lights or the spaces between the words in a lighted message may preferably be left unlighted.

It is known to wire Christmas tree light strings in series and to use shunt-type incandescent lamps in those strings so that, if the filament of a lamp burns out, a series connection in the string is nonetheless maintained and the remaining lamps in the string remain lit. The present invention provides a replacement blank for such an incandescent lamp for use in those regions of the string where no light or lights are desired.

SUMMARY OF THE INVENTION

In accordance with the present invention, a replacement blank is provided for a removable incandescent lamp of the type that is typically insertable into one of multiple series-connected sockets which form a string of lights. The replacement blank comprises a base which is adapted to be removably inserted into one of the sockets, and electrically conductive means on the base for maintaining the series connection in the light string.

Preferably, the blank includes a cap for the base which is adapted to rest on and close the socket when the base is inserted therein. The base is also preferably adapted to be press fit into the socket and held therein by frictional force. Alternately, the socket and base may be provided with cooperating threads to accommodate removable screw-type insertion of the blank.

In a preferred embodiment, the conductive means has an electrical resistance approximately equal to the resistance of the lamp which it replaces. The conductive means preferably comprises a metal strip which is secured to the end of the base of the blank. The blank is preferably molded from plastic and the metal strip is partially embedded in the molded plastic blank.

BRIEF DESCRIPTION OF THE DRAWINGS

FIG. 1 is a generally schematic representation of a string of decorative lights showing use of the replacement blanks of the present invention.

FIG. 2 is an enlarged side elevation of one particularly preferred embodiment of the present invention.

FIG. 3 is a sectional view of the blank shown in FIG. 2.

FIG. 4 is a bottom plan view of the blank shown in FIG. 2.

FIG. 5 is a sectional view, similar to FIG. 3, showing an alternate embodiment.

FIG. 6 is an enlarged side elevation of another embodiment of the replacement blank of the subject invention.

FIG. 7 is a vertical section through the blank of FIG. 6.

FIG. 8 is an electrical schematic of a conventional string of lights showing use of the replacement blank of the present invention.

DETAILED DESCRIPTION OF THE PREFERRED EMBODIMENT

FIG. 1 shows a portion of the outside of a house on which a conventional decorative light string 10 is attached. The light string 10 includes the use of conventional incandescent lamps 11 and replacement blanks 12 of the present invention. As seen in the figure, the light string 10 is used to outline the windows 13 and the replacement blanks 12 are used in two portions of the string where decorative lighting is not desired, namely, a first portion 14 from the end of the string, including the plug 16 to one corner of the window 13, and a second portion 15 between the two windows.

One of the more popular kinds of decorative light strings utilizes miniature incandescent lamps which include an integral shunt to assure circuit continuity in the event a lamp filament burns out. Such a light string circuit is shown schematically in FIG. 8. The circuit includes a number of identical series-connected sockets 17 into two of which are inserted conventional miniature shunt-type incandescent lamps 11 and into the other is inserted a blank 12 of the present invention. Each of the lamps 11 is constructed with an integral shunt 18 which provides continued uninterrupted flow of current should the filament 20 burn out and open. However, to maintain conductivity through the shunt 18, the lamp 11 must remain in the socket 17. If the lamp is removed from the socket, the circuit is opened and all of the lamps will go out. However, the three wire construction shown provides circuit continuity between the plug 16 on one end and the plug receptacle 21 on the other end, so that other series connected light strings at either end of string 10 are unaffected.

Referring also to FIGS. 2–4, there is shown the preferred embodiment of the lamp replacement blank 12 of the present invention, particularly adapted to replace a plug-in miniature lamp of one well known and widely used construction. The blank includes a unitary body 22 which includes a base 23 and an upper cap 24. A conductive metal strip 25 is secured to the base 23 of the blank body 22 and provides a substitute for the shunt 18 of a lamp 11. When a lamp 11 is removed from a socket 17 and replaced with a blank 12, the ends of the conductive strip 25 contact the circuit leads 19 in the socket and electrically close the same in a manner equivalent to the lamp shunt. The substitution of the conductive strip 25 of the blank for the shunt 18 of the lamp is shown schematically in FIG. 8.

The conductive strip 25 is preferably made of a short piece of copper wire 26 which is embedded at its center in the base 23 of the body 22. The body is preferably molded from plastic and the wire 26 may be conveniently attached during the molding process. As shown in FIGS. 2–4, the wire 26 is shaped in the form of a W with the center 27 captured in the molded plastic base 23. The opposite ends 28 of the wire remain free and are easily bent to conform to the shape of the socket when inserted. The sides of the body 22 may be provided with integral tapered lands 29, spaced around the outside of the body and extending axially in a downwardly convergent direction from the underside of the cap 24. The lands 29 provide a lead-in and also help frictionally retain the blank 12 in place within the socket 17.

FIG. 5 shows an alternate conductive strip in the form of a copper wire 30 of a generally U-shaped configuration. The wire 30 is also preferably embedded in the base 23 as a part of the molding process.

FIGS. 6 and 7 show an alternate construction of a replacement blank 31 provided with an outer thread pattern 32 adapted to cooperate with a threaded socket. The body 33, including the thread pattern 32, is provided with a conductive coating 34, which coating continues to the tip 35 of the base. The electrical resistance of the conductive coating 34 and the resistance of the conductive strip 25 of the previously described embodiment are preferably approximately equal to the resistance of the lamp which is replaced.

I claim:

1. A replacement blank for a removable incandescent lamp of the type insertable into one of multiple series-connected sockets forming a string of lights, said blank comprising:

a base adapted for removable insertion into one of the sockets; and, electrically conductive means on said base for maintaining the series connection in said string.

2. The invention as set forth in claim 1 including a cap for said base adapted to rest on and close said socket when the base is inserted therein.

3. The invention as set forth in claim 1 wherein said base is adapted to be press fit into said socket and held therein by frictional force.

4. The invention as set forth in claim 1 wherein said socket and said base are provided with operating threads for removable insertion of said blank.

5. The invention as set forth in claim 1 wherein said conductive means has an electrical resistance approximately equal to the resistance of the incandescent lamp which is replaced.

6. The invention as set forth in claim 1 wherein said conductive means comprises a metal strip secured to the end of said base.

7. The invention as set forth in claim 6 wherein said blank is made of molded plastic and said metal strip comprises a piece of wire partially embedded in said plastic.

* * * * *